US009180672B2

(12) United States Patent
Mitsuo

(10) Patent No.: US 9,180,672 B2
(45) Date of Patent: Nov. 10, 2015

(54) LIQUID EJECTING APPARATUS

(71) Applicant: SEIKO EPSON CORPORATION, Tokyo (JP)

(72) Inventor: Noritaka Mitsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/211,108

(22) Filed: Mar. 14, 2014

(65) Prior Publication Data

US 2014/0285584 A1 Sep. 25, 2014

(30) Foreign Application Priority Data

Mar. 25, 2013 (JP) ..... 2013-062207

(51) Int. Cl.
*B41J 2/175* (2006.01)
*B41J 29/38* (2006.01)

(52) U.S. Cl.
CPC . *B41J 2/175* (2013.01); *B41J 29/38* (2013.01)

(58) Field of Classification Search
USPC ..... 347/7, 85
See application file for complete search history.

(56) References Cited

U.S. PATENT DOCUMENTS 5,963,236 A * 10/1999 Miyashita et al. ..... 347/85
6,863,386 B2 * 3/2005 Hatada et al. ..... 347/84
8,459,765 B2 * 6/2013 Harada ..... 347/9
8,491,110 B2 * 7/2013 Muto ..... 347/85
8,602,513 B2 * 12/2013 Ara et al. ..... 347/7
2012/0188316 A1 7/2012 Matsuoka et al.

FOREIGN PATENT DOCUMENTS

| | | |
|---|---|---|
| JP | 11-309855 | 11/1999 |
| JP | 2004-358946 | 12/2004 |
| JP | 2011-218613 | 11/2011 |
| JP | 2012-061615 | 3/2012 |
| JP | 2012-152972 | 8/2012 |

* cited by examiner

*Primary Examiner* — Ahn T. N. Vo
(74) *Attorney, Agent, or Firm* — Workman Nydegger

(57) ABSTRACT

There is provided a liquid ejecting apparatus including: a head that discharges liquid having a component which settles down; a storage section that stores the liquid; a supply path that supplies the liquid from the storage section to the head through a path which extends in a horizontal direction; and an acceleration section that accelerates a part of the supply path which includes at least the path with acceleration having a downward acceleration component in the vertical direction. The supply path may include a upstream part which is connected to the storage section, a first connection part which is connected to the upstream part, a horizontal part which is connected to the first connection part and which extends in the horizontal direction, a second connection part which is connected to the horizontal part, and a downstream part which is connected to the second connection part and the head. At this time, the acceleration section accelerates the horizontal part relatively to the upstream part and the downstream part with the acceleration.

7 Claims, 12 Drawing Sheets

(FIRST REFERENCE EXAMPLE)

(SECOND REFERENCE EXAMPLE)

(FIRST EMBODIMENT)

LIQUID EJECTING APPARATUS

BACKGROUND

1. Technical Field

The present invention relates to a liquid ejecting apparatus.

2. Related Art

An ink jet-type image forming apparatus, which discharges ink (a kind of liquid) from a head and forms an image, is known as a liquid ejecting apparatus from the related art. In the ink jet-type image forming apparatus, there is a case in which a pigment component of ink settles down in an ink supply path that supplies the ink from an ink tank in which the ink is stored toward the head (hereinafter, there is a case in which the sedimentation of the pigment component of the ink is simply called "sedimentation of the ink"). For example, white ink has a white pigment component which is included in the ink and easily settles down, and thus the white ink is a typical example of sedimentary ink. When ink settles down, the concentration of an output image is deviated from an intended concentration, and thus a problem occurs in that image quality is lowered. In order to solve the problem, for example, JP-A-2012-152972 proposes a method of stirring ink by circulating the ink using a pump.

However, in the ink jet-type image forming apparatus, an ink supply path includes a considerably long section which extends in the horizontal direction (hereinafter, referred to as a horizontal part). More specifically, in a large printer capable of performing large paper printing, there are a large number of extremely long horizontal parts.

Since sedimentation of the ink occurs in such a horizontal part, it is necessary to stir the ink in the horizontal part. However, in the handling method of circulating the ink using a pump disclosed in JP-A-2012-152972, when the horizontal part is long, it takes considerable time until the concentration of the ink is actually uniform (in other words, the ink is homogenized), and thus it is inefficient. The problem is particularly severe in a large printer which includes an extremely long horizontal part.

SUMMARY

An advantage of some aspects of the invention is to provide a liquid ejecting apparatus which effectively homogenizes liquid in the horizontal part of a liquid supply path.

According to an aspect of the invention, there is provided a liquid ejecting apparatus including: a head that discharges liquid having a component which settles down; a storage section that stores the liquid; a supply path that supplies the liquid from the storage section to the head through a path which extends in a horizontal direction; and an acceleration section that accelerates a part of the supply path which includes at least the path with acceleration having a downward acceleration component in the vertical direction.

The other features of the invention will be apparent with the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
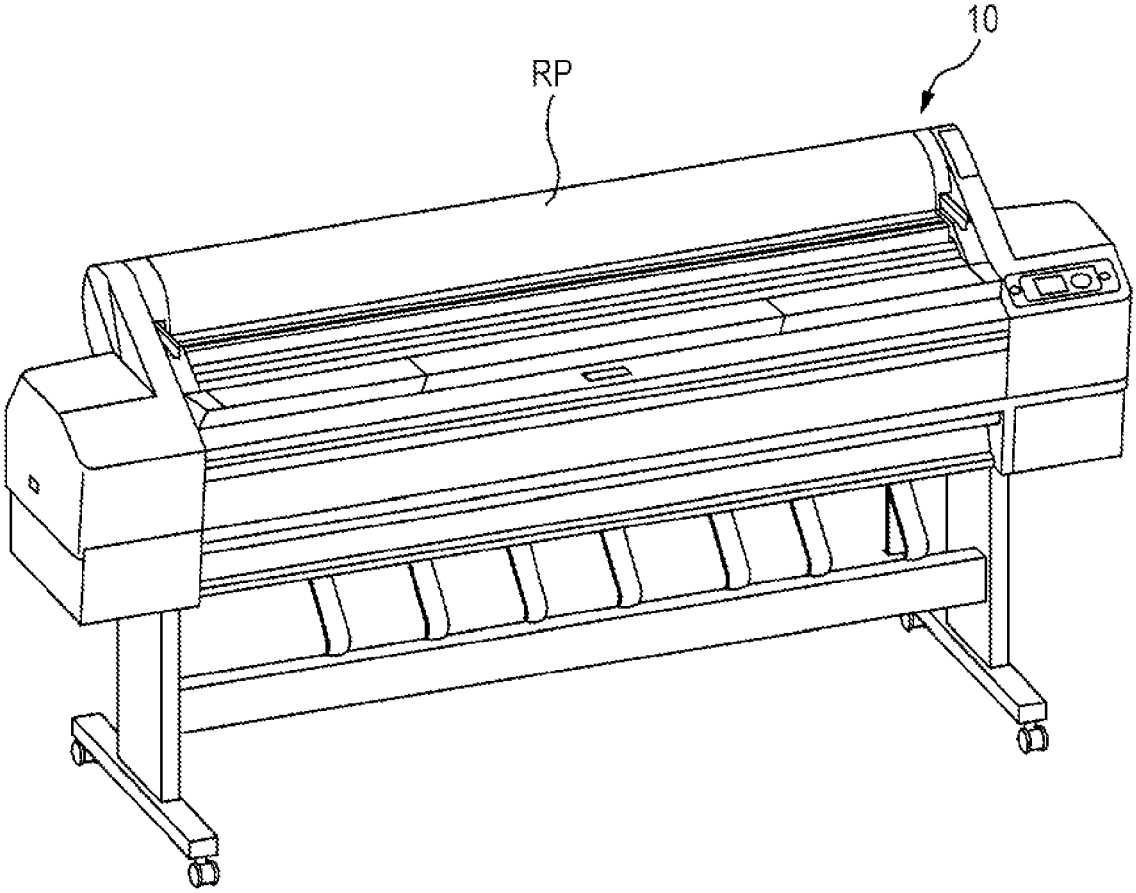
FIG. 1 is an external view illustrating a printer which is a liquid ejecting apparatus according to a first embodiment of the invention.

At least the following configurations become apparent with the specification and the accompanying drawings. In particular, according to an aspect of the invention, there is provided a liquid ejecting apparatus including: a head that discharges liquid having a component which settles down; a storage section that stores the liquid; a supply path that supplies the liquid from the storage section to the head through a path which extends in a horizontal direction; and an acceleration section that accelerates a part of the supply path which includes at least the path with acceleration having a downward acceleration component in the vertical direction.

In the liquid ejecting apparatus according to the aspect, a liquid supply path in the path which extends in the horizontal direction is accelerated with the acceleration having the downward acceleration component in the vertical direction. Therefore, in a static system of the liquid supply path (that is, a system which moves together with the liquid supply path), inertia force in the upward vertical direction is applied to sedimentary components which are concentrated on the lower layer section of the liquid. Due to the inertia force, the sedimentary components move in the liquid in the upward vertical direction, and thus there is an advantage in that the liquid is actually stirred. In this manner, the liquid is stirred by only accelerating the liquid supply path. Therefore, in the liquid ejecting apparatus according to the aspect, the liquid is effectively homogenized.

Here, in the liquid ejecting apparatus according to the aspect, the supply path may include: a pipe-shaped upstream part which has one end connected to the storage section; a first pipe-shaped connection part which has one end connected to another end of the upstream part and which has flexibility; a pipe-shaped horizontal part which has one end connected to another end of the first connection part and which extends in the horizontal direction; a second pipe-shaped connection part which has one end connected to another end of the horizontal part and which has flexibility; and a pipe-shaped downstream part which has one end connected to another end of the second connection part and another end connected to the head. The acceleration section may accelerate the horizontal part relatively to the upstream part and the downstream part with the acceleration. The first connection part and the second connection part may have clearance for securing at least movement distance in which the horizontal part moves relatively to the upstream part and the downstream part until the acceleration of the horizontal part is completed by the acceleration section, and may be respectively connected between the upstream part and the horizontal part and between the horizontal part and the downstream part before movement of the horizontal part starts.

According to the aspect, it is possible to avoid a state in which the upstream part and the downstream part are drawn due to the movement and acceleration of the horizontal part and in which a large amount of load is applied to the upstream part and the downstream part.

In addition, according to the aspect, each of the first connection part and the second connection part may be configured from a material which is relatively flexible compared to the horizontal part, the upstream part, and the downstream part.

According to the aspect, some extensibility is present in the first and second connection parts, and thus it is further possible to avoid the state in which the upstream part and the downstream part are drawn due to the movement and sudden stop of the horizontal part and in which a large amount of load is applied to the upstream part and the downstream part.

In addition, according to the aspect, the acceleration section may include: a support member that supports the horizontal part and that is capable of moving in a vertical direction together with the supported horizontal part; a support member moving section that moves the support member upward in the vertical direction; and an abutting member that is provided above the support member in the vertical direction, and applies acceleration in the downward vertical direction, which changes a movement velocity of the support member upward in the vertical direction to zero by abutting on the support member which moves upward in the vertical direction and suddenly stopping movement of the support member, to the support member.

According to the aspect, it is possible to realize the acceleration with an easy configuration in the acceleration in the downward vertical direction.

In addition, according to the aspect, the liquid ejecting apparatus may further include a control section that controls the support member moving section such that the support member moves, and controls the support member moving section after the movement of the support member stops such that the support member returns to the position before the movement.

According to the aspect, it is possible to repeatedly perform the abutment of the support member on the abutting member.

Here, according to the aspect, the liquid ejecting apparatus may receive a designation of an extent of a time interval, at which the support member abuts on the abutting member, from a user. The control section may perform control such that the support member moves and may perform control after the movement stops such that the support member returns to a position before the movement at every designated time interval.

According to the aspect, it is possible to change the frequency of the stirring of the liquid based on the abutment of the support member on the abutting member depending on a situation.

For example, according to the aspect, as the duration of a state in which the liquid is not discharged from the head is long, the control section may perform control such that the support member moves and may perform control after the movement stops such that the support member returns to the position before the movement at a short time interval.

In this manner, when the duration of the state in which the liquid is not discharged is long and the sedimentation of the sedimentary components is severe, it is possible to rapidly recover the sedimentation. In addition, when the duration of the state in which the liquid is not discharged is not so long and the sedimentation of the sedimentary components is not so severe, it is possible to prevent sedimentation from progressing by performing periodical stirring at a time interval which is long to some extent.

In addition, in the aspect, the acceleration section may accelerate the part of the supply path with the acceleration regardless of whether or not the liquid is discharged from the head.

In the stirring of the liquid using a pump, it is necessary to circulate the liquid after the flow path which reaches the head and the storage section is closed using a valve or the like. Therefore, it is necessary to stop discharging the liquid from the head first. In contrast, when the part of the supply path in the path which extends in the horizontal direction is accelerated as the invention, it is not necessary to close the flow path which reaches the head and the storage section. Therefore, the invention is not restricted. That is, the stirring of the liquid according to the invention has an advantage in that a liquid discharging efficiency from the head is not lowered.

First Embodiment

FIG. 1 is an external view illustrating a printer 10 which is a liquid ejecting apparatus according to a first embodiment of the invention.

The printer 10 is an ink jet-type printer. The printer 10 draws a medium from a roll body RP having a configuration in which a belt-shaped medium is wound in a roll state, and outputs an image to the drawn medium. As the medium, it is possible to use a medium which is formed of a material, for example, paper, a film, or cloth, and which has a considerably large width (approximately the same as the width of the roll body RP) of, for example, 64 inches. As above, the printer 10 is a printer which can perform large-sized paper printing, and is a considerably large-sized printer compared to a general printer which outputs an image to A4 paper.

Figure 2:
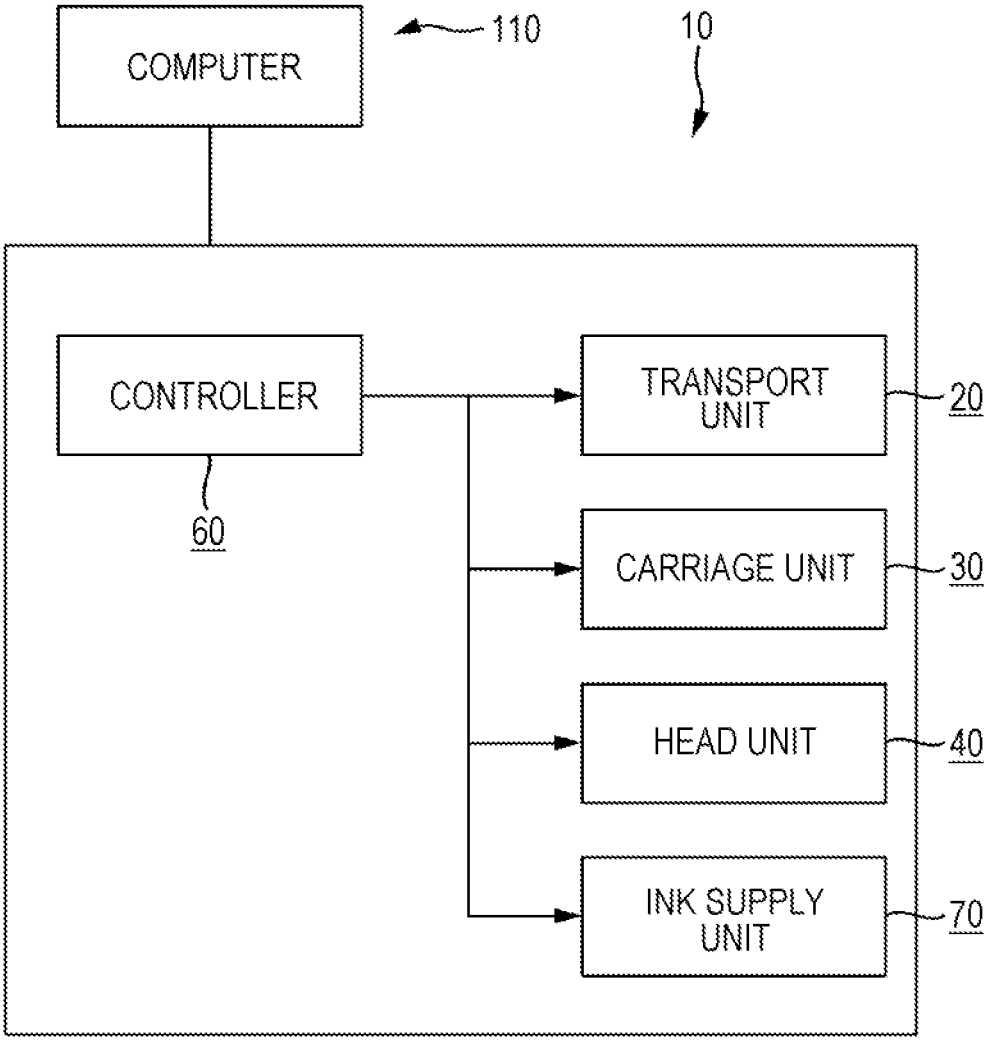
FIG. 2 is a block diagram illustrating the printer shown in FIG. 1.

FIG. 2 is a block diagram illustrating the printer 10 shown in FIG. 1.

The printer 10 is connected to a computer 110 which is an external apparatus, receives print data from the computer 110, and outputs an image which is based on the print data on a medium. The printer 10 includes a transport unit 20 (meanwhile, refer to FIG. 1), a carriage unit 30, a head unit 40, an ink supply unit 70, and a controller 60 as elements in order to output the image.

Figure 3:
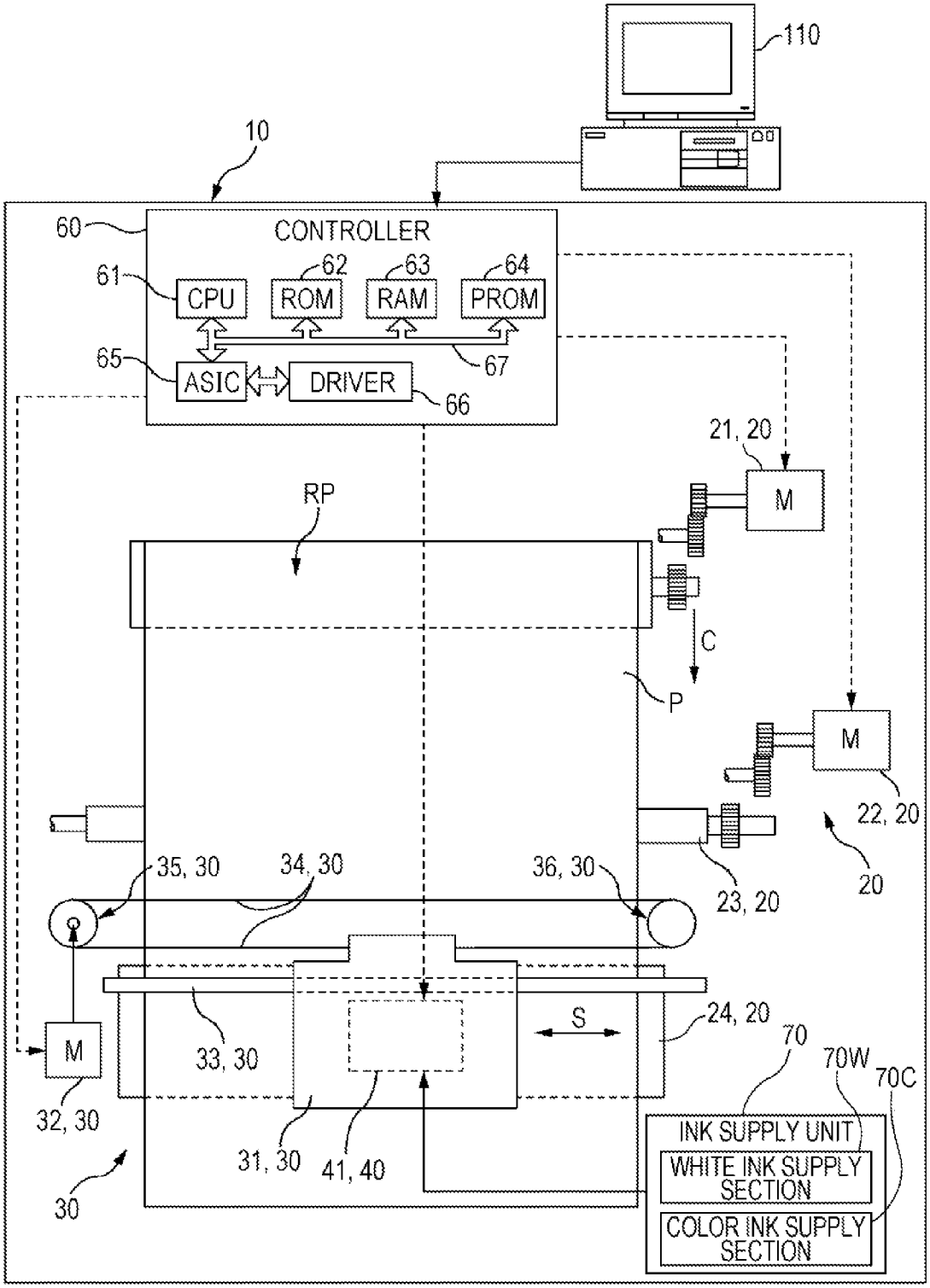
FIG. 3 is a schematic configuration diagram illustrating the printer shown in FIGS. 1 and 2.

FIG. 3 is a schematic configuration diagram illustrating the printer 10 shown in FIGS. 1 and 2. Hereinafter, elements shown in FIG. 2 will be described with reference to FIG. 3.

The controller 60 has a role of controlling each of the units (the transport unit 20, the carriage unit 30, and the head unit 40) in various operations of the printer 10. For example, the controller 60 receives print data from the computer 110 via an interface, which is not shown in the drawing, and outputs an image by controlling each of the units based on the print data. Here, the states in the printer 10 are monitored by various sensors, and the controller 60 controls each of the units based on a result of detection which is output from the various sensors. The controller 60 includes a CPU 61, a ROM 62 (a read-only ROM), a RAM 63, a PROM 64 (a writable ROM), an ASIC 65, a driver 66, and the like as components to control each of the units, and the components are connected to each other via a transmission path 67 such as a bus.

The transport unit 20 is a device which transports a medium P in a transport direction, which is shown by an arrow C in the drawing. The transport unit 20 includes a feeding motor 21, a transport motor 22, a transport roller 23, a platen 24, a first gear train, which is not shown in the drawing, and a second gear train, which is not shown in the drawing. The transport roller 23 is a roller which transports the medium P in the transport direction in such a way that the medium P is placed and rotated. In addition, the transport motor 22 is the power source of rotational drive force to rotate the transport roller 23, and the rotational drive force of the transport motor 22 is transmitted to the transport roller 23 through a first gear train, which is not shown in the drawing, and thus the transport roller 23 is rotated. The platen 24 is a member which supports a portion of the medium P to which an image is output. The feeding motor 21 is the power source of rotational drive force to rotate the roll body RP. The rotational drive force of the feeding motor 21 is transmitted to the roll body RP through a second gear train, which is not shown in the drawing, and thus the roll body RP is rotated. Therefore, the medium P is drawn from the roll body RP and supplied to the transport roller 23. When the feeding motor 21 performs rotational drive on the roll body RP, sliding between the transport roller 23 and the medium P is suppressed, and thus it is possible to perform highly-precise transport control. Here, the controller 60 controls the drive of the feeding motor 21 and the transport motor 22.

The carriage unit 30 is a device which causes a head 41, which will be described later, to reciprocate in a main scan direction shown by a bidirectional arrow S in the drawing. The carriage unit 30 includes a carriage 31, a carriage motor 32, a carriage guide 33, a belt 34, a pulley 35, and a belt stretching roll 36. The carriage 31 is a member in which the head 41 is mounted and which can reciprocate in the main scan direction. The carriage motor 32 is the power source of drive force to move the carriage 31. The carriage guide 33 is a member which guides the carriage 31 through the main scan direction. The belt 34, the pulley 35, and the belt stretching roll 36 are members to transmit the drive force of the carriage motor 32 to the carriage 31. More specifically, the transmission of the drive force is performed as follows. The rotational drive force of the carriage motor 32 is transmitted to the pulley 35 through a mechanism, which is not shown in the drawing, and the pulley 35 is rotated. The belt 34 is stretched to the pulley 35 and the belt stretching roll 36. When the pulley 35 is rotated, the belt 34 circularly moves between the pulley 35 and the belt stretching roll 36. At this time, the belt stretching roll 36 rotates in accordance that the belt 34 circularly moves. Meanwhile, the direction in which the belt 34 circularly moves is determined depending on the direction in which the carriage motor 32 rotates. Here, the carriage 31 is fixed to a part of the belt 34, and is supported by the carriage guide 33 in a state in which the carriage 31 can reciprocated in the main scan direction. Therefore, if the belt 34 circularly moves, the carriage 31 moves in any of the main scan directions (the right direction or the left direction in the drawing) according to the direction in which the belt 34 circularly moves along the carriage guide 33. Here, the controller 60 controls the drive of the carriage motor 32 which is a drive source for the movement of the carriage 31 (control of a rotation direction is included).

The head unit 40 is a device which discharges ink to the medium P. The head unit 40 includes a head 41 having a plurality of nozzles. As described above, the head 41 is mounted on the carriage 31, and the head 41 moves together with the movement of the carriage 31. Here, when the head 41 intermittently discharges ink toward the medium P above the platen 24 while the head 41 moves in the main scan direction, a dot line (raster line) along the main scan direction is formed on the medium P. The controller 60 also controls the discharge of ink from the head 41.

Figure 4:
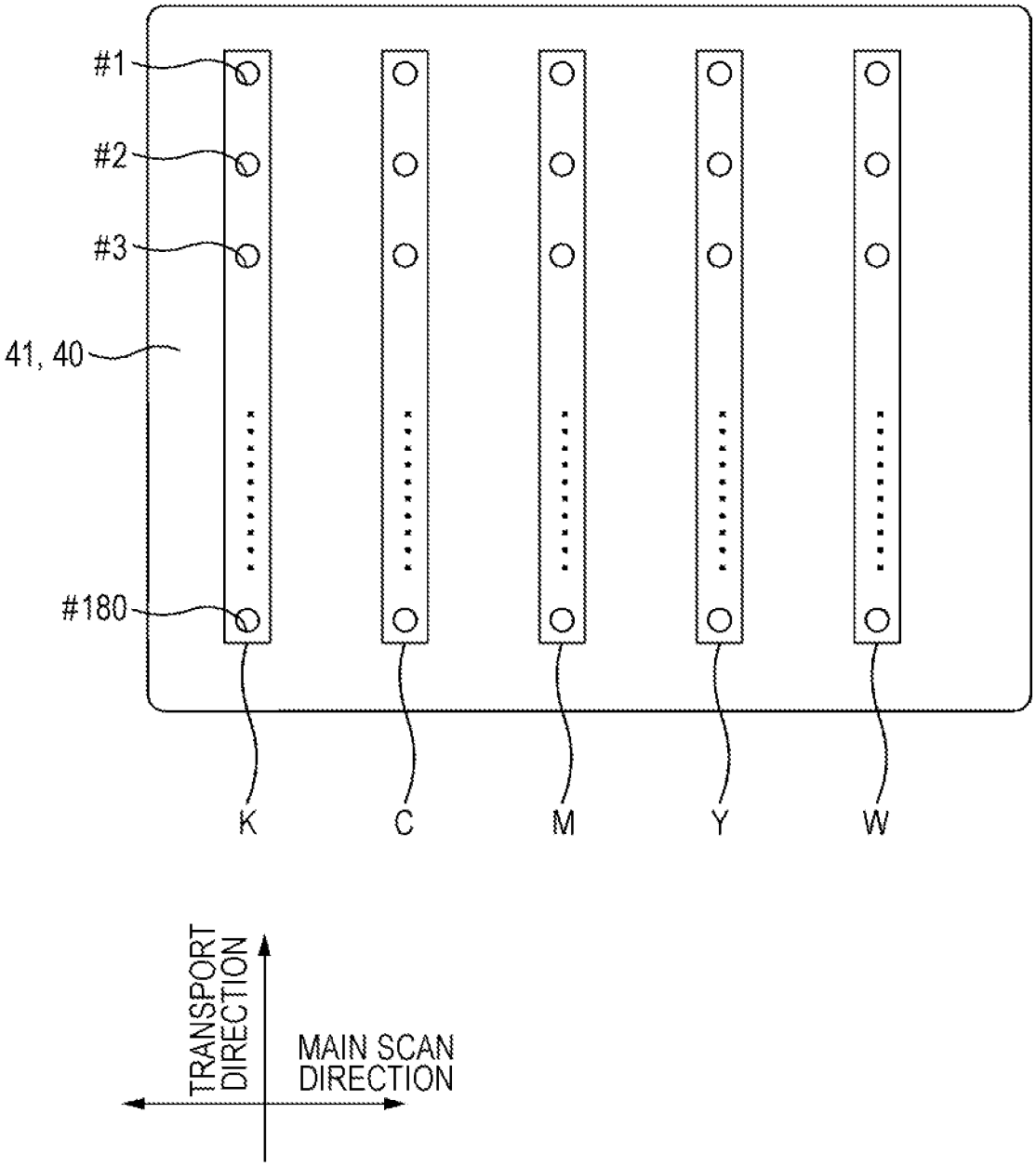
FIG. 4 is an explanatory diagram illustrating the arrangement of nozzles on the lower surface of a head.

FIG. 4 is an explanatory diagram illustrating the arrangement of the nozzles on the lower surface of the head 41.

A black ink nozzle row K, a cyan ink nozzle row C, a magenta ink nozzle row M, a yellow ink nozzle row Y, and a white ink nozzle row W which respectively discharge black ink, cyan ink, magenta ink, yellow ink, and white ink are formed on the lower surface of the head 41. Each of the nozzle rows includes a plurality of nozzles (180 in the embodiment) which are discharge openings to discharge ink of each color. The plurality of nozzles of each of the nozzle rows are aligned at predetermined intervals (nozzle pitches), respectively, along the transport direction of the medium P. In the drawing, numbers #1 to #180 are sequentially assigned to the nozzles of each of the nozzle rows from the nozzles on the lower stream side in the transport direction.

The white ink of the five types of ink is ink to print the background color (white color) of a color image when, for example, the color image is output to a transparent medium. In this manner, when the white color is used for the background, the color image is easily viewed. Meanwhile, when the brightness (L*) and the chromaticity (a*, b*) of the white ink, which is discharged to Epson pure photo paper <gloss> (product made by Seiko Epson Corporation) at a duty of 100% or greater, are measured by setting a light source of D50, a field of view of 2°, a concentration of DIN_NB, a white reference of Abs, a filter of No, and a measurement mode of Reflectance for the measurement conditions of a Spectrophotometer Spectrolino (product name: made by GretagMacbeth Company), it is preferable that the white ink show ranges that $70 \leq L^* \leq 100$, $-4.5 \leq a^* \leq 2$, and $-6 \leq b^* \leq 2.5$.

Here, the white ink includes a white pigment as the color material thereof. As the white pigment, for example, metallic oxide, Barium sulphate, calcium carbonate, and the like are exemplified. As the metallic oxide, for example, titanium dioxide, zinc oxide, silica, alumina, magnesium oxide, and the like are exemplified. From the viewpoint of excellent brightness, titanium dioxide is preferable from among them. If the white ink is left for a long time, the white ink is easily thickened and solidified. In addition, the white ink is a kind of so-called sedimentary ink, the white pigment of which is easily settled down if the white ink is left for a long time. Here, the sedimentary ink quantitatively has absorbance which becomes 95% or less within 24 hours. Hereinafter, the sedimentation of a pigment component in sedimentary ink, such as the white ink, is called "sedimentation of ink" as an abbreviation.

In contrast, the remaining four-color ink (hereinafter, referred to as "color ink" in a lump) other than the white ink of the five-color ink is ink which does not settle down as much as the white ink.

Description returns to FIG. 3 and is continued.

The ink supply unit 70 is a device which supplies each color ink to each of the color ink nozzle rows of the head 41 which is shown in FIGS. 3 and 4. The ink supply unit 70 includes a white ink supply section 70W which supplies the white ink to the white ink nozzle row W for the white ink shown in FIG. 4, and a color ink supply section 70C which supplies color ink to the color ink nozzle rows for the color ink (the black ink nozzle row K, the cyan ink nozzle row C, magenta ink nozzle row M, and the yellow ink nozzle row Y). Each color ink, which is discharged from the head 41 and is consumed when an image is formed, is supplied by the white ink supply section 70W and the color ink supply section 70C. The configuration of each of the ink supply sections will be described in detail later.

Subsequently, an image forming operation of the printer 10 will be described. In the image forming operation, the controller 60 performs the reception of an image forming command, paper feeding control, dot forming control, transport control, sheet discharge determination and image forming completion determination. Each of the units in the printer 1 described with reference to FIGS. 2 and 3 executes a process in correspondence to the operation of the controller 60. The operation of the controller 60 and the flow of the process performed by each of the units in accordance with the operation of the controller 60 will be simply described.

The reception of the image forming command means that an image forming command from the computer 110 shown in FIG. 3 is received through an interface, which is not shown in the drawing.

The paper feeding control is control performed such that the medium P which is an image forming target is moved in a transport direction, indicated by an arrow C in FIG. 3, and is positioned in an image forming start position (so-called cueing position). In the paper feeding control, the controller 60 moves the medium P by controlling the drive of the feeding motor 21 and the transport motor 22 in the transport unit 20.

The dot forming control is control in order to form dots on the medium P. In the dot forming control, the controller 60 controls the carriage motor 32 in the carriage unit 30 such that the carriage 31 is driven, and outputs a control signal to the head 41 of the head unit 40. Piezoelectric elements in the head 41 are driven based on the control signal, and thus ink is discharged toward the medium P above the platen 24 from each of the nozzles. Due to the dot forming control, dots are formed on the medium P in the direction in which the carriage moves.

The transport control is control performed such that rolled paper is moved in the transport direction. The controller 60 intermittently transports the medium P in the transport direction per prescribed transport quantity (transport quantity corresponding to one page) by controlling the feeding motor 21 and the transport motor 22 in the transport unit 20. Therefore, a new dot is formed in a position which is slightly deviated from a position of a dot formed by a previous dot forming operation on the upstream side in the transport direction.

The image forming completion determination is performed to determine whether or not to continue the image forming operation. The controller 60 performs the image forming completion determination based on the presence or non-presence of the print data from the computer 110.

Subsequently, the ink supply unit 70 shown in FIG. 3 will be described in detail.

As described above, the ink supply unit 70 includes the white ink supply section 70W and the color ink supply section 70C. Hereinafter, the configuration of the white ink supply section 70W included in the two ink supply sections will be described. However, before description is made, a white ink supply section according to a first reference example and a white ink supply section according to a second reference example which have different configurations from the ink supply unit 70 will be previously described from a point of view which clarifies the features of the configuration. Meanwhile, with regard to the color ink supply section 70C, a configuration which is the same as the configuration of the following white ink supply section according to the first reference example is used. Therefore, with regard to the color ink supply section 70C, description of the following white ink supply section according to the first reference example is referred to, and the description of the color ink supply section 70C will not be repeated.

Figure 5A:
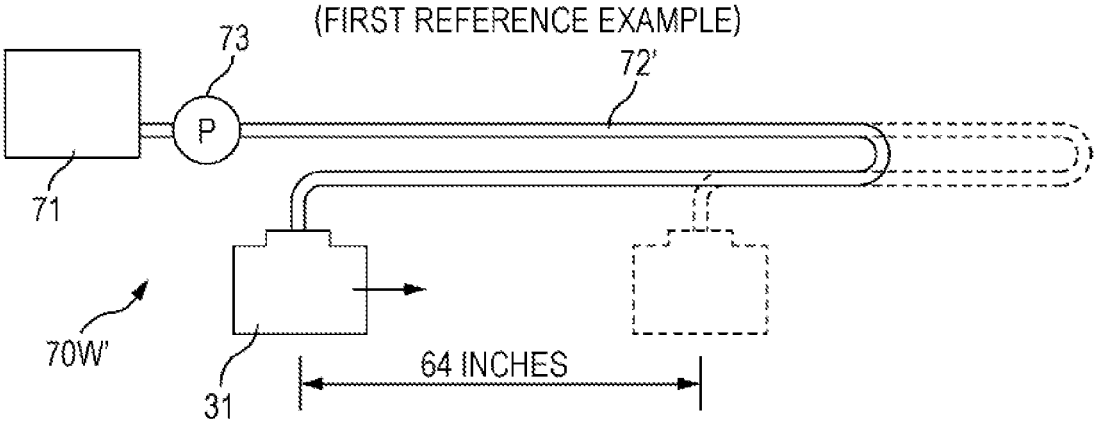
FIG. 5A is an explanatory diagram illustrating a white ink supply section according to a first reference example.

FIG. 5A is an explanatory diagram illustrating a white ink supply section 70W' according to the first reference example.

The white ink supply section 70W' according to the first reference example includes a tank 71, a supply path 72', and a pressure pump 73. The tank 71 is a storage section which stores the white ink. The supply path 72' is a pipe-shaped tube to supply the white ink from the tank 71 to the head 41. Meanwhile, in description below, description will be made using the same reference numerals which indicate the same components as the components according to the embodiment (for example, the carriage 31 and the like) in the components according to the first reference example shown in FIG. 5A.

As shown in FIG. 5A, the supply path 72' is horizontally extended from the side of the tank 71 toward the right direction in the drawing, folded, horizontally extended toward the left direction in the drawing, and is connected to the carriage 31 (to be exact, connected to the head 41 in the carriage 31, which is shown in FIGS. 3 and 4). In other words, the supply path 72' is a pipe installed such that a path between the tank 71 and the carriage 31 has a U-shape. Here, the position of the carriage 31, which is shown using a solid line in FIG. 5A, is the position of the carriage 31 acquired when the white ink is discharged to one end portion of the medium P shown in FIG. 3 in the left and right direction, the position of the carriage 31, which is shown using a doted-line in FIG. 5A, is the position of the carriage 31 acquired when the white ink is discharged to another end portion of the medium P, shown in FIG. 3, in the left and right direction. That is, the distance from the position of the carriage 31, which is shown using a solid line to the position of the carriage 31 which is shown using the dotted one, is the length of the width of the medium P, for example, 64 inches. When the carriage 31 moves from the position of the carriage 31, which is shown using the solid line to the position of the carriage 31 which is shown using the dotted line in the arrow direction of the drawing, the supply path 72' changes the shape, as shown using the dotted line in the drawing, and follows the movement of the carriage 31. As shown in the drawing, in the supply path 72', a portion which extends in the horizontal direction occupies most of the supply path 72'. In order to cause the white ink to flow in the horizontal direction, the pressure pump 73 is provided which applies pressure to the white ink in the tank 71 and supplies the white ink to the supply path 72'.

Figure 6A:
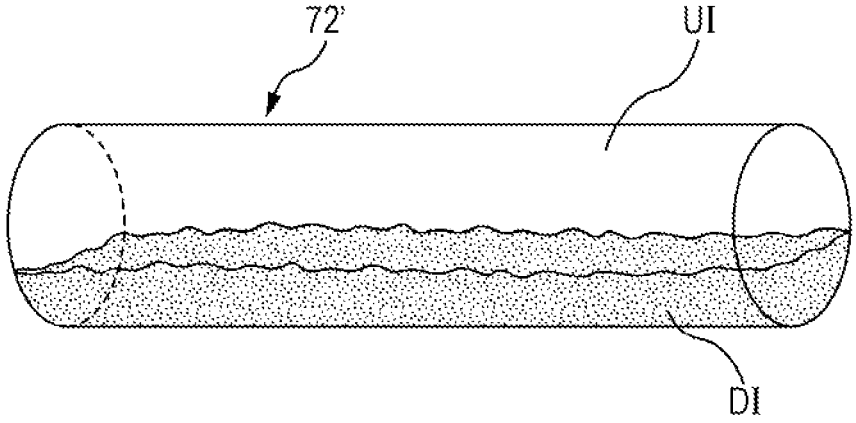
FIG. 6A is an explanatory diagram illustrating the sedimentation of the white ink in a horizontal part of a supply path according to the first reference example.

FIG. 6A is an explanatory diagram illustrating the sedimentation of the white ink in the horizontal part of the supply path 72' according to the first reference example.

If a state in which the white ink does not flow into the supply path 72' is continued for a long time while the white ink is not discharged from the head 41 which is mounted on the carriage 31, shown in FIG. 3, for a long time, the pigment component of the white ink settles down. In particular, in a portion of the supply path 72' which extends in the horizontal direction, the pigment component of the white ink settles down on the lower layer of ink along the bottom surface of the supply path 72'. In FIG. 6A, from a point of view of simplification of description, a state in which ink is polarized into lower layer ink LI which has a relatively high ink concentration (that is, a relatively large amount of pigment components) and upper layer ink UI which has a relatively low ink concentration (that is, a relatively small amount of pigment components) is shown as an example.

If an image is output to a medium in a state in which the pigment of the white ink is settled down in this way, upper layer ink UI which has a low concentration, low viscosity and high fluidity is supplied to the head 41 more than lower layer ink LI which has a relatively high concentration, high viscosity, and low fluidity in the supply path 72, with the result that the concentration of the output image is deviated from an intended concentration, and thus a problem occurs in that image quality is lowered. For example, because the background color (white) is insufficient, a situation occurs in which the ground color of the medium is conspicuous.

Figure 5B:
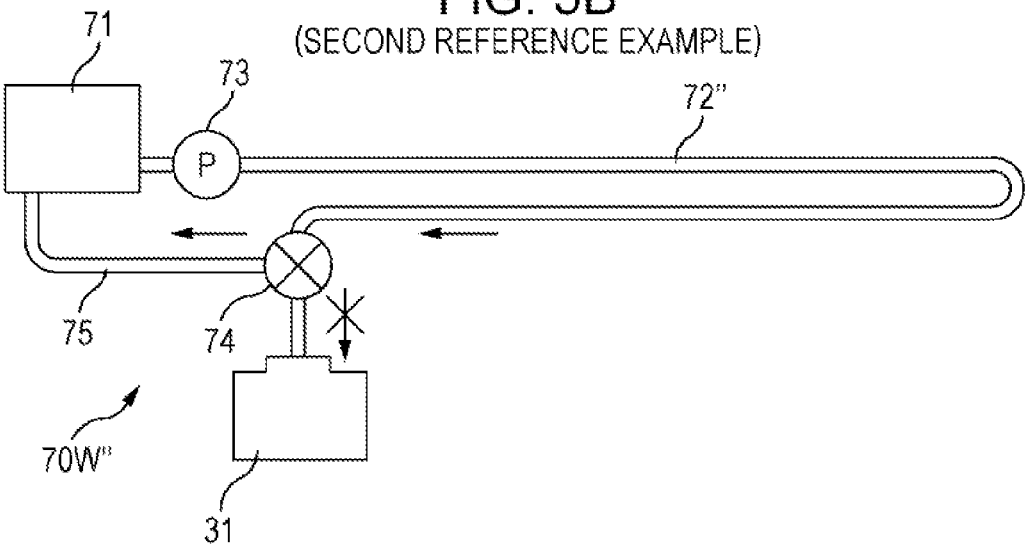
FIG. 5B is an explanatory diagram illustrating a white ink supply section according to a second reference example.

FIG. 5B is an explanatory diagram illustrating a white ink supply section 70W" according to the second reference example.

Hereinafter, description will be made in such a way that the same reference numbers are used to indicate the same components as the components (for example, the carriage 31, and the like) according to the embodiment and the same components as the components according to the first reference example shown in FIG. 5A from among the components according to the second reference example shown in FIG. 5B. The white ink supply section 70W" according to the second reference example includes a tank 71, a supply path 72", and a pressure pump 73. The supply path 72' is a pipe-shaped tube which supplies the white ink from the tank 71 to the head 41. Further, in order to recover a state in which the white pigment of the white ink settles down, the white ink supply section 70W" includes a switching valve 74 and a recirculation passage 75 as mechanisms which circulate the white ink. Here, the switching valve 74 is a valve which switches over the flow path of the white ink.

When an image is formed, the switching valve 74 opens a flow path to the head 41 which is mounted on the carriage 31 and is shown in FIGS. 3 and 4, and supplies ink which is supplied from the supply path 72" to the head 41. In contrast, when the situation in which the pigment of the white ink settles down is recovered, the switching valve 74 blocks the flow path to the head 41, returns the white ink which is supplied from the supply path 72" to the tank 71 through the recirculation passage 75, and circulates the white ink. In the second reference example, the white ink is stirred by circulating the white ink in this way, and thus the white ink is homogenized.

However, in a method of stirring the white ink by circulating the white ink as in the second reference example, there is a problem in that it takes time until the white ink is homogenized. The reason for this is that, while the upper layer ink UI shown in FIG. 6A has a low concentration and low viscosity and is easily flown, the lower layer ink DI has a high concentration and high viscosity and is difficultly flown. In particular, in a printer in which the width of the medium P is 64 inches and the horizontal part of the supply path of the white ink is considerably long when compared to a general printer like the printer 10 according to the embodiment, it takes a considerably long time until the white ink is actually homogenized if the white ink is stirred using the ink circulation mechanism as in the second reference example.

In addition, in a method of stirring the white ink by circulating the white ink as in the second reference example, there is a problem in that an image forming efficiency is lowered. The reason for this is that, since it is necessary to block the supply of ink to the head 41 using the switching valve 74 in order to circulate ink in the method, it is difficult to stir the white ink if the image forming operation is not stopped.

Figure 5C:
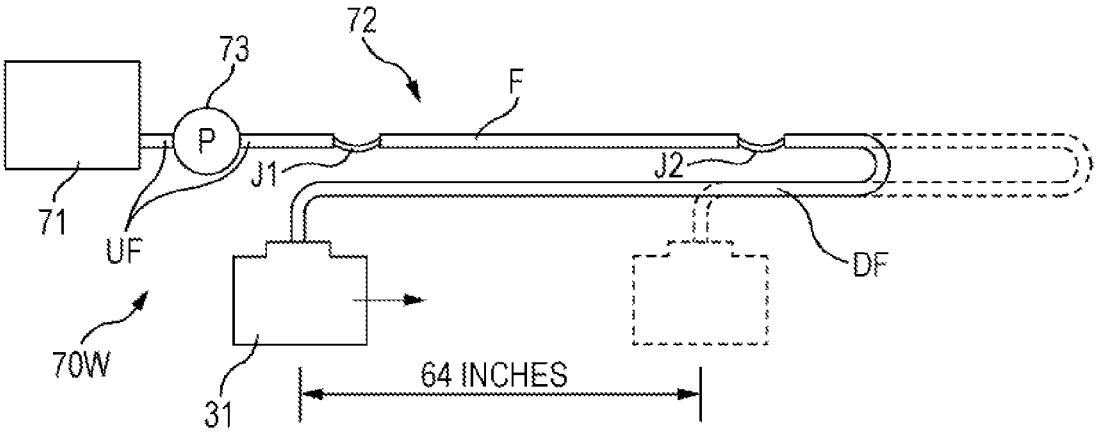
FIG. 5C is an explanatory diagram illustrating a white ink supply section according to the first embodiment of the invention.

FIG. 5C is an explanatory diagram illustrating a white ink supply section 70W according to the first embodiment of the invention.

The white ink supply section 70W includes a tank 71 that is a storage section which stores the white ink, a pipe-shaped supply path 72 that supplies the white ink in the tank 71 to the head 41 which is mounted on the carriage 31 and is shown in FIGS. 3 and 4, and a pressure pump 73 that applies pressure to the white ink in the tank 71 and supplies the white ink to the supply path 72. The supply path 72 has a U-shaped form in general as in the first reference example, and the supply path 72 is configured to include a horizontal part F which extends in the horizontal direction on the upper side part of the U-shaped form, two connection parts J1 and J2 on both sides of the horizontal part F, an upstream part UF which is provided on a rather upstream side in the ink supply direction than the connection part J1, and a downstream part DF which is provided on a rather downstream side in the ink supply direction than the connection part J2. In the first embodiment of the invention, an acceleration mechanism, which will be described later, is included. With the acceleration mechanism, it is possible to accelerate the horizontal part F in the downward (downward of the drawing) direction of the vertical direction.

Figure 6B:
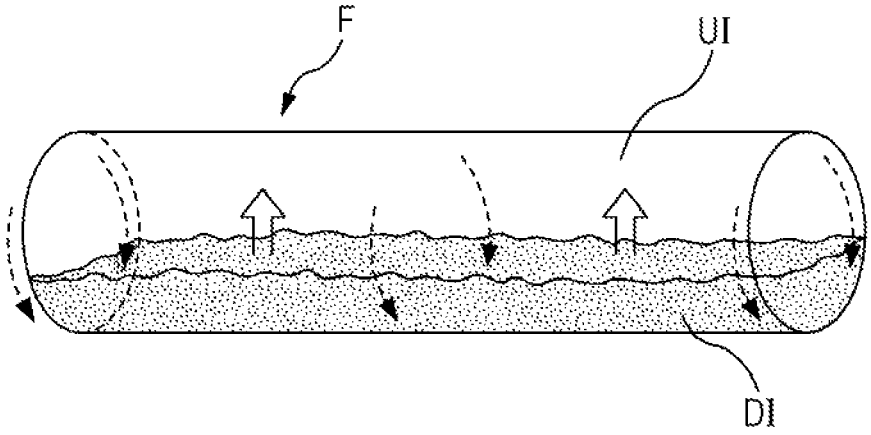
FIG. 6B is an explanatory diagram illustrating the state of the white ink in the horizontal part immediately after acceleration starts.
Figure 6C:
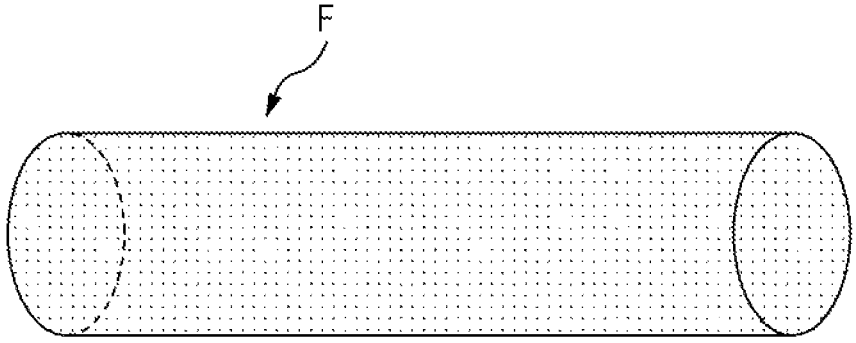
FIG. 6C is an explanatory diagram illustrating the state of the white ink in the horizontal part after acceleration is completed.

FIG. 6B is an explanatory diagram illustrating the state of the white ink in the horizontal part F immediately after acceleration is started, and FIG. 6C is an explanatory diagram illustrating the state of the white ink in the horizontal part F after acceleration is completed.

Hereinafter, for the purpose of simplification of description, description is made while it is assumed that, before acceleration is performed on the horizontal part F, the white ink in the horizontal part F is divided into lower layer ink LI which has a relatively high ink concentration (that is, a relatively large amount of pigment components) and upper layer ink UI which has a relatively low ink concentration (that is, a relatively small amount of pigment components) as shown in FIG. 6A.

If the horizontal part F is accelerated, inertia force in the upward vertical direction is applied to the upper layer ink UI and the lower layer ink LI when considered from a system which moves together with the horizontal part F (that is, the static system of the horizontal part F). Immediately after the acceleration, the upper layer ink UI is blocked by the inner wall on the upper side of the horizontal part F, and thus it is almost difficult for the upper layer ink UI to move to the upper side. In contrast, the lower layer ink LI pushes up the upper layer ink UI, and thus the lower layer ink LI can move to the upper side. The upper layer ink UI is prevented from moving to the inner wall on the upper side of the horizontal part F and is pushed up by the lower layer ink LI, and thus upper layer ink UI moves so as to run under the lower side along the inner wall of the lower side of the horizontal part F. In FIG. 6B, the movement direction of the lower layer ink LI immediately after the acceleration is shown by a thick line arrow, the movement direction of the upper layer ink UI is shown by a dotted-line arrow.

In this way, the upper layer ink UI and the lower layer ink LI move such that the vertical position relationship thereof is reversed, and thus an advantage which is equivalent to the case in which the white ink is substantially stirred is acquired. FIG. 6C illustrates a situation after the acceleration is completed, that is, a situation after the white ink is stirred. As shown in the drawing, a state, in which the white ink has uniform concentration and is homogenized, is realized.

Here, unless an enormous amount of acceleration is performed, a distance in which the white pigment in the white ink can be moved by acceleration may generally not be so long. However, if stirring is performed through such acceleration in a spot of the shallow white ink like the horizontal part F, it is possible to realize sufficient homogenization of the concentration. Conversely, when the white ink is stirred in the horizontal part F, the large-scaled stirring mechanism using the ink circulation mechanism as shown in FIG. 5B is not necessary, but rather it is inefficient because it takes time. In particular, when the horizontal part F is long, inefficiency is extremely severe.

Further, since it is possible to perform stirring through the above-described acceleration regardless whether or not the image forming operation is being progressed by the printer, there is an advantage in that it is not necessary to stop the image forming operation in order to stir the white ink first, unlike the stirring mechanism using the ink circulation mechanism shown in FIG. 5B.

In this way, stirring by acceleration according to the first embodiment is an effective method at a point in which the white ink is simply stirred for a short time and at a point in which an image forming efficiency is not lowered.

Hereinafter, an acceleration mechanism which performs acceleration on the horizontal part F and a device which is provided on the side of the supply path 72 for acceleration will be described in detail.

Figure 7A:
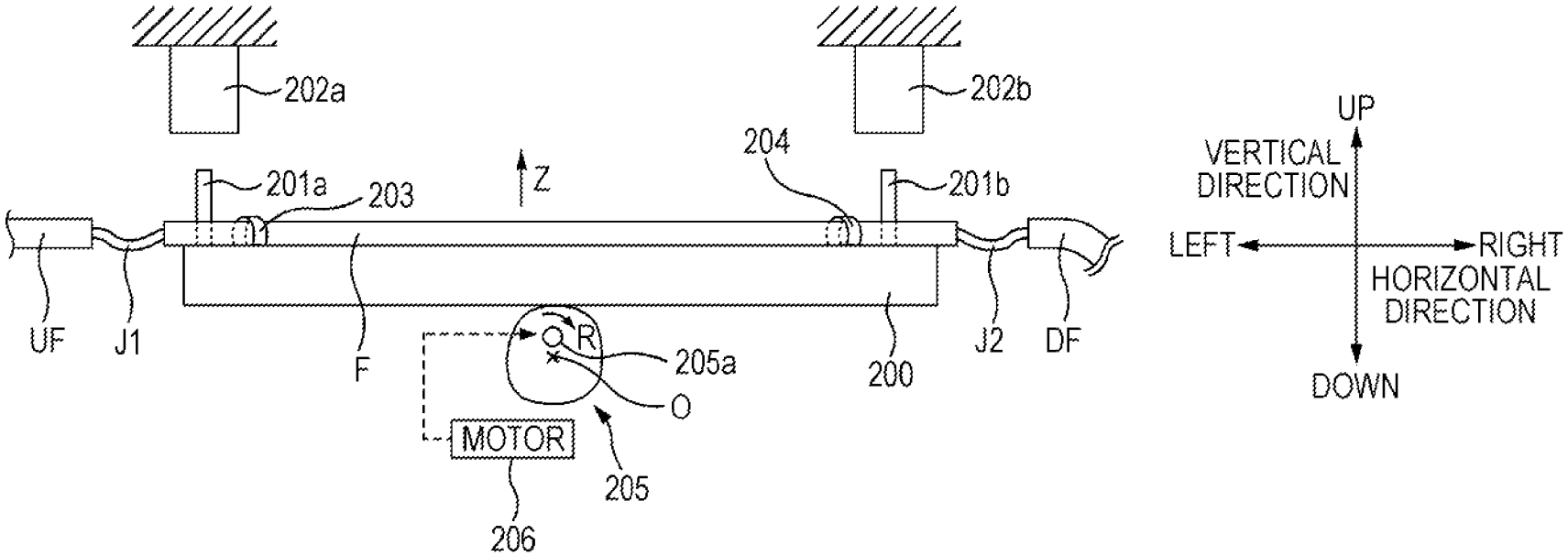
FIG. 7A is a diagram illustrating a state before the horizontal part of the supply path is moved.
Figure 7B:
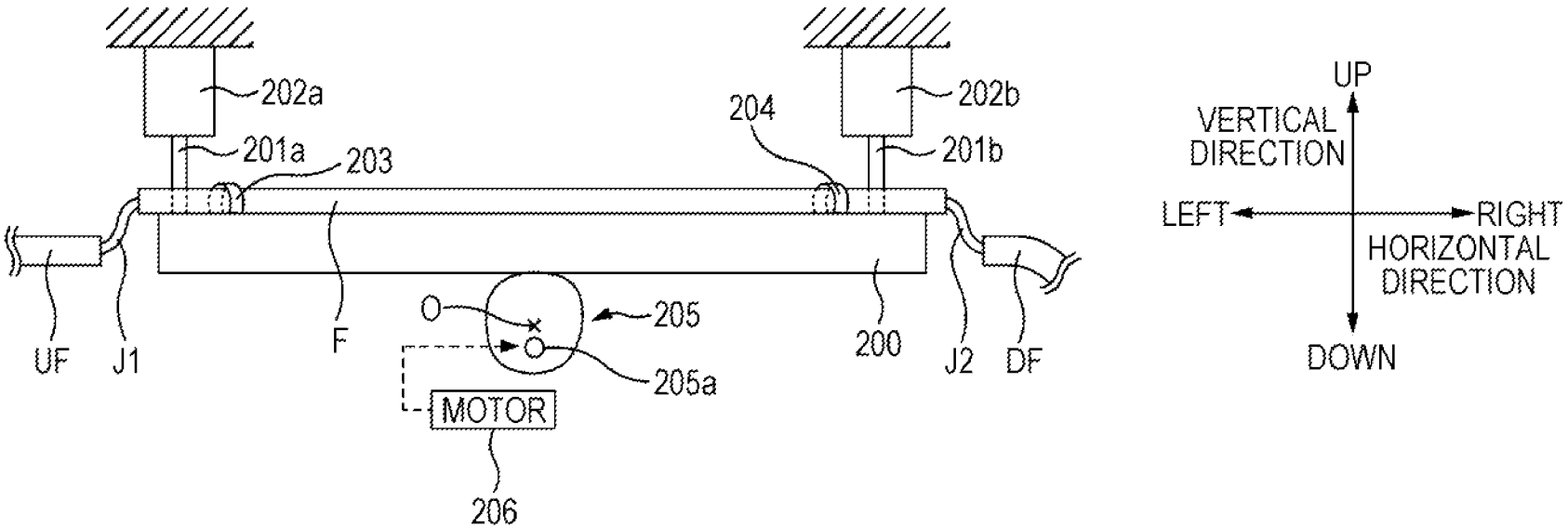
FIG. 7B is a diagram illustrating a state after the horizontal part of the supply path is moved.

FIGS. 7A and 7B are diagrams illustrating the acceleration mechanism which performs acceleration on the horizontal part F of the supply path 72 shown in FIG. 5C, together with the configuration of the supply path 72. In FIGS. 7A and 7B, FIG. 7A illustrates a state before the horizontal part F of the supply path 72 moves, and FIG. 7B illustrates a state after the supply path 72 moves in the horizontal direction.

In description below, for simplification of description, the up and down direction (vertical direction) and the right and left direction (horizontal direction) which are indicated by respective arrows in FIGS. 7A and 7B are used as the references of up, down, right, and left directions in description below.

As simply described in FIG. 5C, the supply path 72 is configured to include the horizontal part F, the two connection parts J1 and J2, the upstream side (tank side) part UF, and downstream side (head side) part DF. All of the following, the horizontal part F, the two connection parts J1 and J2, the upstream side (tank side) part UF, and the downstream side (head side) part DF are configured from so-called pipe-shaped tubes. Here, the horizontal part F, the upstream part UF, and the downstream part DF are configured from tubes which are formed of the same-quality materials. In contrast, although the two connection parts J1 and J2 are also configured from tubes which are formed of the same-quality materials, the materials of the tubes of the two connection parts J1 and J2 are materials which have relatively smaller hardness than the materials of the tubes of the horizontal part F, the upstream part UF, and the downstream part DF (that is, relatively soft).

One ends of the two connection parts J1 and J2 are respectively connected to both ends of the horizontal part F, and the other ends of the two connection parts J1 and J2 are respectively connected to the upstream part UF and the downstream part DF. Here, the upstream part UF indicates an area from the connection spot of the connection section J1 to the tank 71 shown in FIG. 5C in the entire area of the supply path 72, and the downstream part DF indicates an area from the connection spot of the connection section J2 to the carriage 31 shown in FIG. 5C in the entire area of the supply path 72.

The white ink which is flowed from the white ink tank 71 flows through the tubes of the respective parts in order of the upstream part UF, the connection part J1, the horizontal part F, the connection part J2, and the downstream part DF. Here, as shown in FIG. 7A, before the movement of the horizontal part F, the two connection sections J1 and J2 are respectively connected between the upstream part UF and the horizontal part F and between the horizontal part F and the downstream part DF in a state in which the two connection sections J1 and J2 are gently bent. The reason for this is to secure a room for clearance such that the upstream part UF and the downstream part DF do not move around with the movement of the horizontal part F when the horizontal part F moves as will be described below.

The acceleration mechanism includes a support 200, two protrusions 201*a* and 201*b*, two fixed sections 203 and 204, two abutting sections 202*a* and 202*b*, an eccentric cam 205, a cam motor 206, and a power transmission mechanism which transmits the rotational drive force of the cam motor 206 to the eccentric cam 205 and which is not shown in the drawing, as shown in FIGS. 7A and 7B.

The support 200 is a plate-shaped member which spreads out in the horizontal direction of FIG. 7A in which the horizontal part F extends and in the vertical direction with regard to FIGS. 7A and 7B, and the support 200 supports the horizontal part F on the surface thereof. The two fixed sections 203 and 204 are provided on the support 200, and perform functions of fixing the horizontal part F to a prescribed straight line on the support 200. The two protrusions 201*a* and 201*b* are members that are provided on the surface of the support 200 in the direction which is perpendicular to FIGS. 7A and 7B in positions which are slightly deviated on the back side from the prescribed straight line in each drawing, and that protrude from the surface of the support 200 in the upward vertical direction. Here, in FIGS. 7A and 7B, the lower sections of the two protrusions 201*a* and 201*b*, which are normally hidden by the horizontal part F and are not shown, are indicated by dotted lines. In addition, the two abutting sections 202*a* and 202*b* are members that are fixed to positions which are right above the two protrusions 201*a* and 201*b* and which respectively face the two protrusions 201*a* and 201*b*. The eccentric cam 205 is a member that, when rotational drive force is received, uses an eccentric shaft 205*a* as a rotation shaft and rotates around the shaft 205*a*. The eccentric cam 205 is abutted to the lower surface of the support 200. A cam motor 206 performs rotational drive under the control of the controller 60 shown in FIGS. 2 and 3, and the drive force of the cam motor 206 is transmitted to the eccentric cam 205 by a power transmission mechanism which includes a plurality of gears and which is not shown in the drawing. The eccentric cam 205 rotates due to the transmitted rotational drive force while using the shaft 205*a* as a rotation shaft.

FIG. 7A illustrates a state in which the cam motor 206 does not perform rotational drive. In this state, the eccentric cam 205 stops in a state in which the center O thereof is positioned right under the shaft 205*a*. That is, the state is a stable state of the eccentric cam 205. Here, in the eccentric cam 205, a distance from the shaft 205*a* to a spot which is abutted to the lower surface of the support 200 is the shortest when the shaft 205*a* is present on a line which couples an abutting spot to the center O like the stable state shown in FIG. 7A. Therefore, if the cam motor 206 starts performing rotational drive under the control of the controller 60 and the eccentric cam 205 starts rotating in, for example, the R direction in the drawing in the state shown in FIG. 7A, the support 200 is pushed up from the eccentric cam 20 due to the rotation of the eccentric cam 20 and is moved in the Z direction shown in FIG. 7A. Together with the movement of the support 200 in the Z direction, the horizontal part F which is supported on the support 200 is moved in the Z direction. Here, as described above, the two abutting sections 202*a* and 202*b* are present right above the two protrusions 201*a* and 201*b* which are provided on the support 200, and the movement of the support 200 in the X direction suddenly stops in such a way that the two protrusions 201*a* and 201*b* respectively collide with the two abutting sections 202*a* and 202*b*. FIG. 7B illustrates a state when two protrusions 201*a* and 201*b* respectively collide with the two abutting sections 202*a* and 202*b*. In other words, the sudden stop means that the velocity of the support 200 in the upward vertical direction rapidly reaches zero due to a great amount of acceleration in the downward vertical direction in accordance with the abutment. The great amount of acceleration in the downward vertical direction generates a great amount of inertia force in the upward vertical direction when considered from a system which moves together with the support 200 (that is, the static system of the support 200). Due to the inertia force in the upward vertical direction, the white pigment in the white ink, which settles down in the horizontal part F on the support 200, moves in the upward vertical direction, and there is an advantage in that the white ink is actually stirred. The details of the stirring are as described with reference to FIGS. 6B and 6C. In this way, since the white ink is stirred in such a way that only two protrusions 201*a* and 201*b* respectively abut on the two abutting sections 202*a* and 202*b*, it is possible to realize the homogenization of the white ink in a short time.

In the above description, as shown in FIGS. 7A and 7B, the acceleration mechanism, which includes the support 200, the two protrusions 201*a* and 201*b*, the two fixed sections 203 and 204, the two abutting sections 202*a* and 202*b*, the eccentric cam 205, the cam motor 206, and the power transmission mechanism which transmits the rotational drive force of the cam motor 206 to the eccentric cam 205 and which is not shown in the drawing corresponds to an example of the acceleration section of the invention. In addition, a member which combines the support 200, the two protrusions 201*a* and 201*b*, and the two fixed sections 203 and 204 corresponds to an example of the support member of the invention. In addition, a member which combines the eccentric cam 205, the cam motor 206, and the power transmission mechanism, which is not shown in the drawing, corresponds to an example of the support member moving section of the invention. In addition, the two abutting sections 202*a* and 202*b* correspond to an example of the abutting member of the invention.

Here, the connection parts J1 and J2 on both sides of the support 200 are pulled upward in the vertical direction to some extent due to the movement of the horizontal part F on the support 200 until the abutment occurs. However, as described above, in the state before the horizontal part F shown in FIG. 7A is moved, sufficient clearance is secured for the connection parts J1 and J2. Further, since the connection parts J1 and J2 are configured from relatively flexible tubes compared to the horizontal part F, the upstream part UF, and the downstream side part DF, some extensibility is present in the connection parts J1 and J2. Therefore, it is avoided that a large load, such that the upstream part UF and the downstream part DF are pulled strongly because of the movement or sudden stop of the horizontal part F, is placed on the upstream part UF and the downstream part DF.

After the abutment, the controller 60 causes the cam motor 206 to stop performing rotational drive. When the cam motor 206 stops performing rotational drive, the eccentric cam 20 returns to the original stable state shown in FIG. 7A due to torque by the weight of the eccentric cam 20. The controller 60 corresponds to an example of a control section of the invention.

Here, in the printer, a plurality of modes which designates the extent of a time interval, at which the white ink is stirred in the horizontal part F, are respectively provided in correspondence with a plurality of types of time intervals. The user can select a desired mode in the plurality of modes through a user interface, which is not shown in FIGS. 1 and 2, according to a situation. When a mode is designated in the plurality of modes, the controller 60 executes the stirring of the white ink using the above-described acceleration mechanism at a time interval corresponding to the designated mode. That is, the abutment between the protrusions 201*a* and 201*b* and the two abutting sections 202*a* and 202*b* due to the rotational drive of the cam motor 206 and the return of the eccentric cam 20 to a stable state due to the stop of the rotational drive of the cam motor 206 after the abutment are repeated at the corresponding time interval based on the control of the controller 60.

For example, as the duration of a state in which the white ink is not discharged from the head 41, shown in FIGS. 3 and 4, is long, the user can designate a short time interval mode. If such a mode is designated, the white ink is stirred at a short time interval as the duration of the state in which the white ink is not discharged is long based on the control of the controller 60. In this case, for example, when the sedimentation of the white ink is severe because the white ink is not used for a long time, it is possible to rapidly restore the sedimentation of the white ink by increasing a frequency of the stirring of the white ink. In addition, when the white ink is used to some extent and the sedimentation of the white ink is not so severe, the white ink is periodically stirred at a less stirring frequency, and thus it is possible to prevent the sedimentation of the white ink from progressing.

Hereinabove, the first embodiment has been described.

In the description above, when the movement of the horizontal part F in the upward vertical direction is suddenly stopped, acceleration in the downward vertical direction is applied to the horizontal part F. However, instead, the acceleration in the downward vertical direction may be applied to the horizontal part F by causing the horizontal part F to rapidly descend from a stop state in the invention. Even in this case, it is possible to acquire a stirring advantage which is the same as in the first embodiment.

In addition, in the above description, a movement mechanism which uses an eccentric cam 20 as a device that moves the horizontal part F. However, instead, it is possible to use a mechanism which moves the horizontal part F due to electric conduction to a solenoid, electric conduction to a piezoelectric element, voltage application to a polymer actuator which expands and contracts according to the voltage application in the invention. In addition, it is possible to use a mechanical mechanism using the elasticity of a spring.

In addition, in the above description, acceleration in the downward vertical direction is applied to the horizontal part F on the upper side of the U-shaped supply path 72 shown in FIG. 5C. However, in the invention, acceleration in the downward vertical direction may be further applied to the horizontal part which is present on the lower side of the U-shaped supply path 72.

In addition, in the above description, the white ink is flown through the supply path 72 by pressurizing the ink using the pressure pump 73. However, when the tank 71 is installed in a position which is slightly higher than that of the carriage 31 in the vertical direction, the white ink may be flown through the supply path 72 without using the pressure pump 73 due to the water head difference thereof (meanwhile, with regard to this point, the white ink is flown through the supply path due to the water head difference in a second embodiment, which will be described below).

Second Embodiment

In the above-described first embodiment, the plurality of nozzles which configure the nozzle rows are arranged in the transport direction (refer to FIG. 4) and the head 41 which includes the nozzle rows moves in the width direction of the medium P (refer to FIG. 3). However, in the invention, the direction in which the nozzles of the nozzle rows are arranged is not limited to the transport direction. In addition, the direction in which the head moves is not limited to the width direction of the medium. In addition, in the above-described first embodiment, a secondary tank (sub tank) is not provided between the tank 71 and the carriage 31 in the white ink supply section 70W of the ink supply unit 70. However, in the invention, the difference in height may be given to the supply path of the white ink supply section by providing a sub tank between a main tank and the carriage in a position which is relatively higher than the main tank and the carriage.

Hereinafter, the liquid ejecting apparatus according to the second embodiment which is different from the liquid ejecting apparatus according to the first embodiment will be described based on the direction in which the nozzles of the nozzle rows are arranged, the direction in which the head moves, and the presence of the difference in height in the supply path of the white ink supply section.

Similar to the first embodiment, the liquid ejecting apparatus according to the second embodiment is an ink jet-type printer. The configuration and the function (excepting appearance) of the printer according to the second embodiment is greatly different from the printer 1 according to the first embodiment in the direction in which the nozzles of the nozzle rows are arranged, the direction in which the head moves, and the presence of the difference in height in the supply path of the white ink supply section. Excepting these, the printer according to the second embodiment includes a large number of components which are substantially common to the printer 1 according to the first embodiment, and performs the same operations. For example, even in the printer according to the second embodiment, acceleration applied to the horizontal part of the ink supply pipe is repeatedly performed by an acceleration mechanism which is the same as shown in FIGS. 7A and 7B at a time interval corresponding to the mode designated by the user under the control of the controller. Hereinafter, description of configurations and operations which are duplicated with those in the first embodiment will not be repeated, and description will be made while focusing on the large differences. In particular, in the description below, the same reference numerals are used to indicate substantially the same components as in the first embodiment, and the description thereof will not be repeated.

Figure 8:
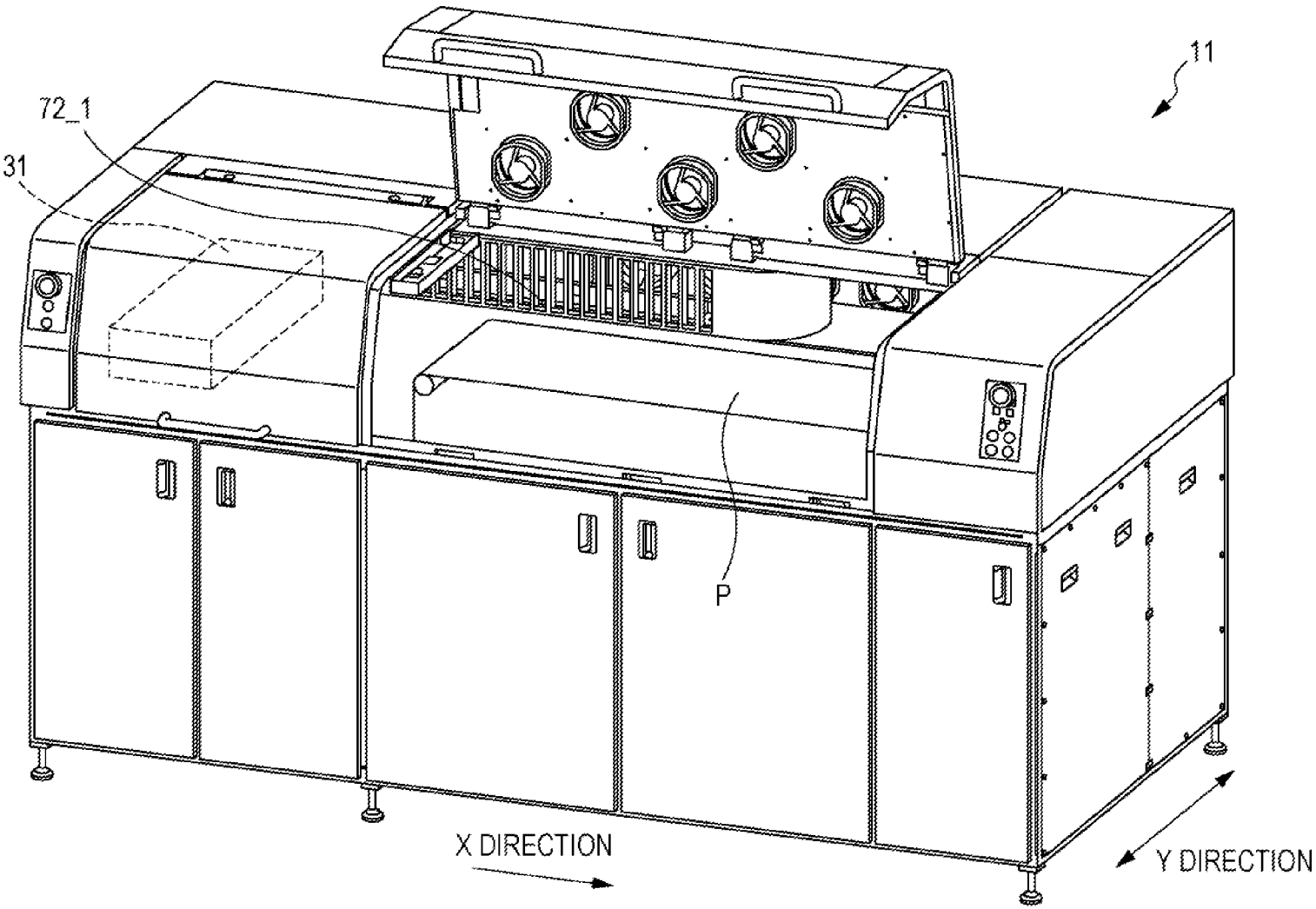
FIG. 8 is an external view illustrating a printer which is a liquid ejecting apparatus according to a second embodiment of the invention.
Figure 9A:
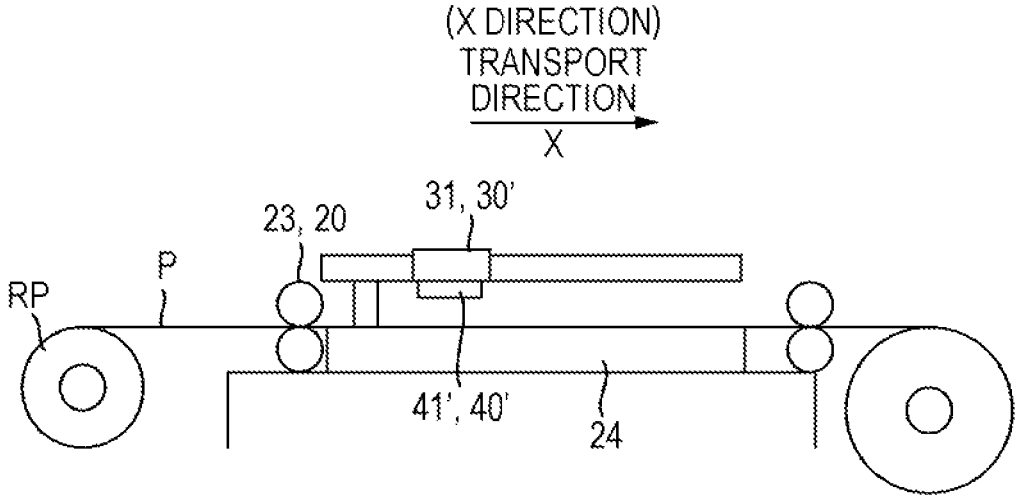
FIGS. 9A and 9B are schematic configuration diagrams illustrating the printer which shows the appearance thereof in FIG. 8.
Figure 9B:
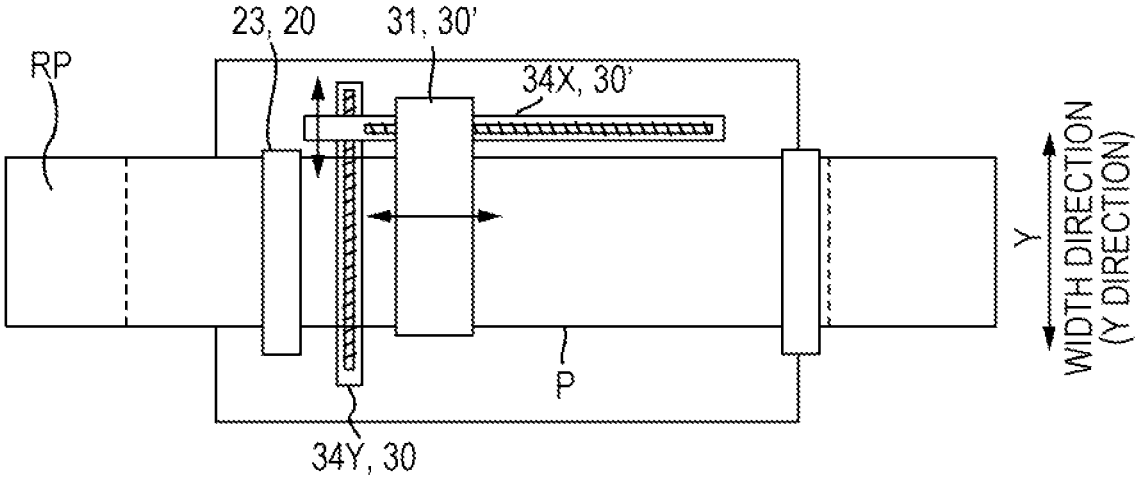

FIG. 8 is an external view illustrating a printer 11 which is a liquid ejecting apparatus according to the second embodiment of the invention. FIGS. 9A and 9B are schematic configuration diagrams illustrating the printer 11, the appearance of which is shown in FIG. 8.

In the printer 11, a transport unit 20 (refer to FIG. 3), a carriage unit 30', a head unit 40', an ink supply unit (further, refer to FIG. 11, which will be described later), which is not shown in FIGS. 8, 9A and 9B, and a controller 60 (refer to FIGS. 2 and 3), which is not shown in FIGS. 8, 9A and 9B, are provided. Meanwhile, in the description below, there is a case in which the transport direction of a medium P is called an X direction and the width direction of the medium P is called a Y direction.

The carriage unit 30' includes a carriage 31. Further, the carriage unit 30' includes an X shaft stage 34X and a Y shaft stage 34Y as carriage movement mechanisms which 2-dimensionally move the carriage 31. The X shaft stage 34X moves the carriage 31, on which the head unit 40' is mounted, in the X direction (transport direction of the medium P), which is indicated by an arrow X in FIGS. 8, 9A and 9B, and the reverse direction thereof. In contrast, the Y shaft stage 34Y moves the carriage 31 in the Y direction (width direction of the medium P), which is indicated by a bidirectional arrow Y in FIGS. 8, 9A and 9B, together with the X shaft stage 34X.

The ink supply unit includes a white ink supply section 70W_1 (refer to FIG. 11, which will be described later) which supplies the white ink and a color ink supply section (not shown in the drawing) which supplies color ink.

The head unit 40' includes a plurality of heads which are mounted on the carriage 31, and FIG. 9A illustrates a single head 41' as a representative of the plurality of heads.

Figure 10A:
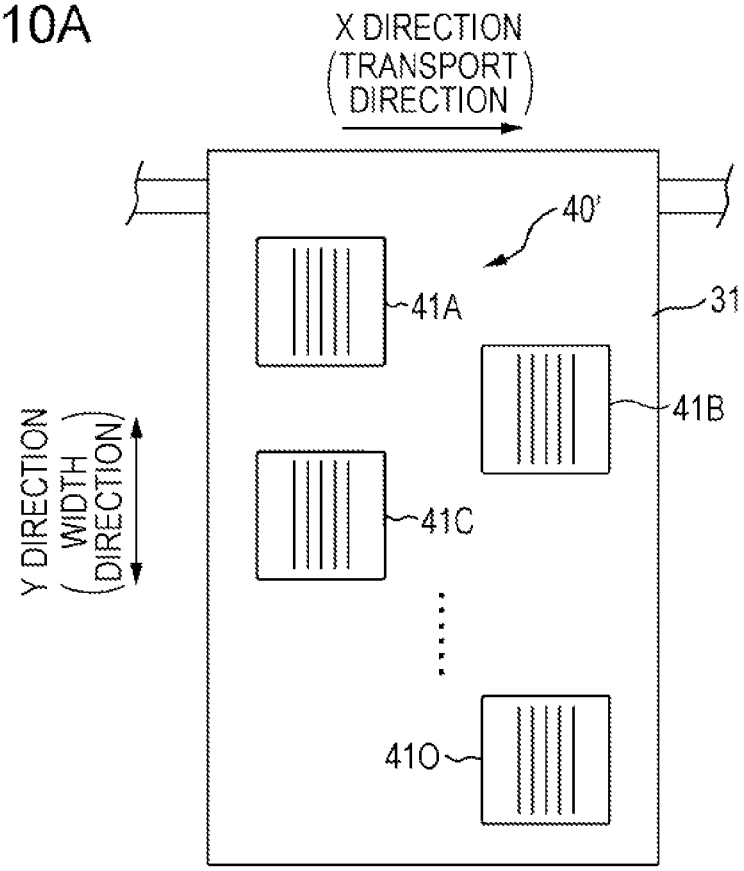
FIG. 10A is an explanatory diagram illustrating the arrangement of a plurality of heads in a head unit.
Figure 10B:
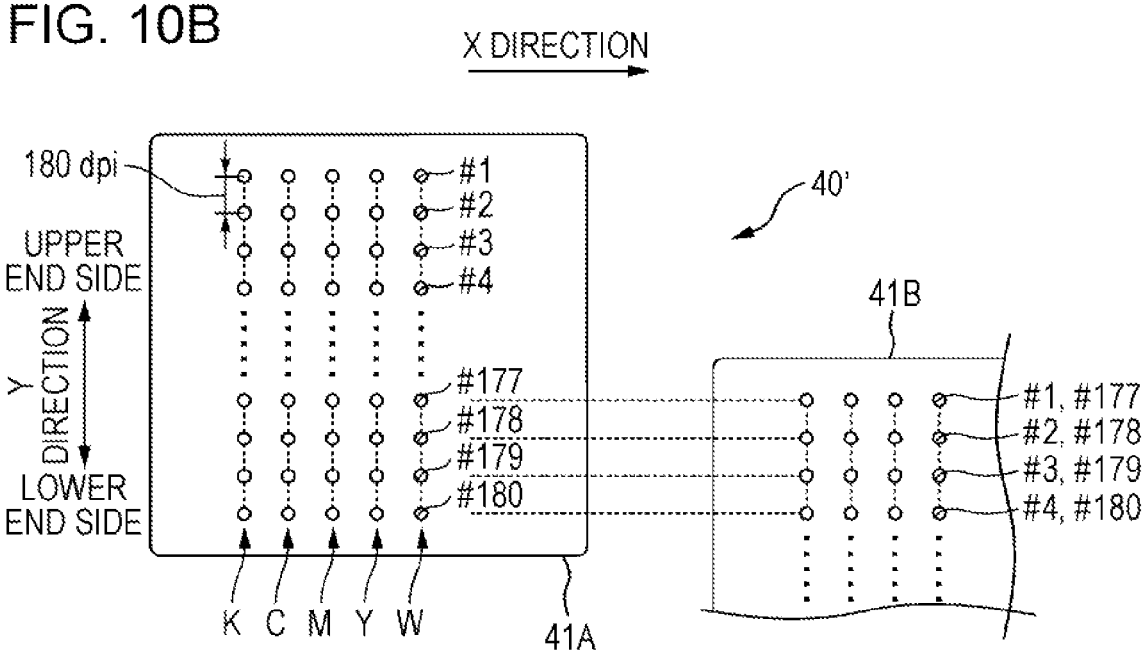
FIG. 10B is an explanatory diagram illustrating the arrangement of nozzles in the head.

FIG. 10A is an explanatory diagram illustrating the arrangement of the plurality of heads in a head unit 40', and FIG. 10B is an explanatory diagram illustrating the arrangement of nozzles in the head.

The head unit 40' includes 15 heads 41A, 41B, 41C, . . . 41O as the above-described plurality of heads, and the 15 heads are arranged in a zigzag pattern in the Y direction as shown in FIG. 10A. Each of the heads is provided with 5 nozzle rows which correspond to the respective color ink, and nozzles which consist of each nozzle row are arranged in the Y direction (width direction of the medium P). Further, when ink is intermittently discharged from each of the heads while the carriage 31 on which the heads 41' are mounted moves in the X direction (the transport direction of the medium P) or the reverse direction thereof, a dot line (raster line) is formed on the medium P along the transport direction.

In the printer 11, an operation (pass) of moving the carriage 31 in the X direction or in the reverse direction thereof and an operation of moving the carriage 31 in the Y direction are alternately repeated under the control of the controller 60, and thus an image is formed on the medium P above the platen 24. After the image is formed on the medium P above the platen 24, the transport roller 23 of the transport unit 20 is driven, the medium P is drawn and transported from the roll body RP, and a new non-printed area of the medium P is set above the platen 24 under the control of the controller 60. In the printer 11, such an image formation and transportation are alternately repeated under the control of the controller 60, and thus the image is output to the medium P.

As described above, the carriage 31 moves in the X direction (the transport direction of the medium P) and the reverse direction thereof in addition to the Y direction (width direction of the medium P). Therefore, a maximum movable distance (that is, a maximum movement distance in the horizontal direction), acquired when the carriage 31 temporarily moves in a straight line in an XY plane, corresponds to the length of the diagonal of a rectangle which has two sides, that is, a drive range in the Y direction acquired by the Y shaft stage 34Y (corresponding to the length of the width of the medium P) and a drive range in the X direction acquired by the X shaft stage 34X, and the maximum movement distance is longer than the length of the width of the medium P (approximately 64 inches). More specifically, the maximum movement distance reaches approximately two meters. In contrast, in the first embodiment, the maximum movement distance of the carriage 31 coincides with the width of the medium P and is the extent of approximately 64 inches. The second embodiment is different from the first embodiment in the maximum movement distance of the carriage 31.

Figure 11:
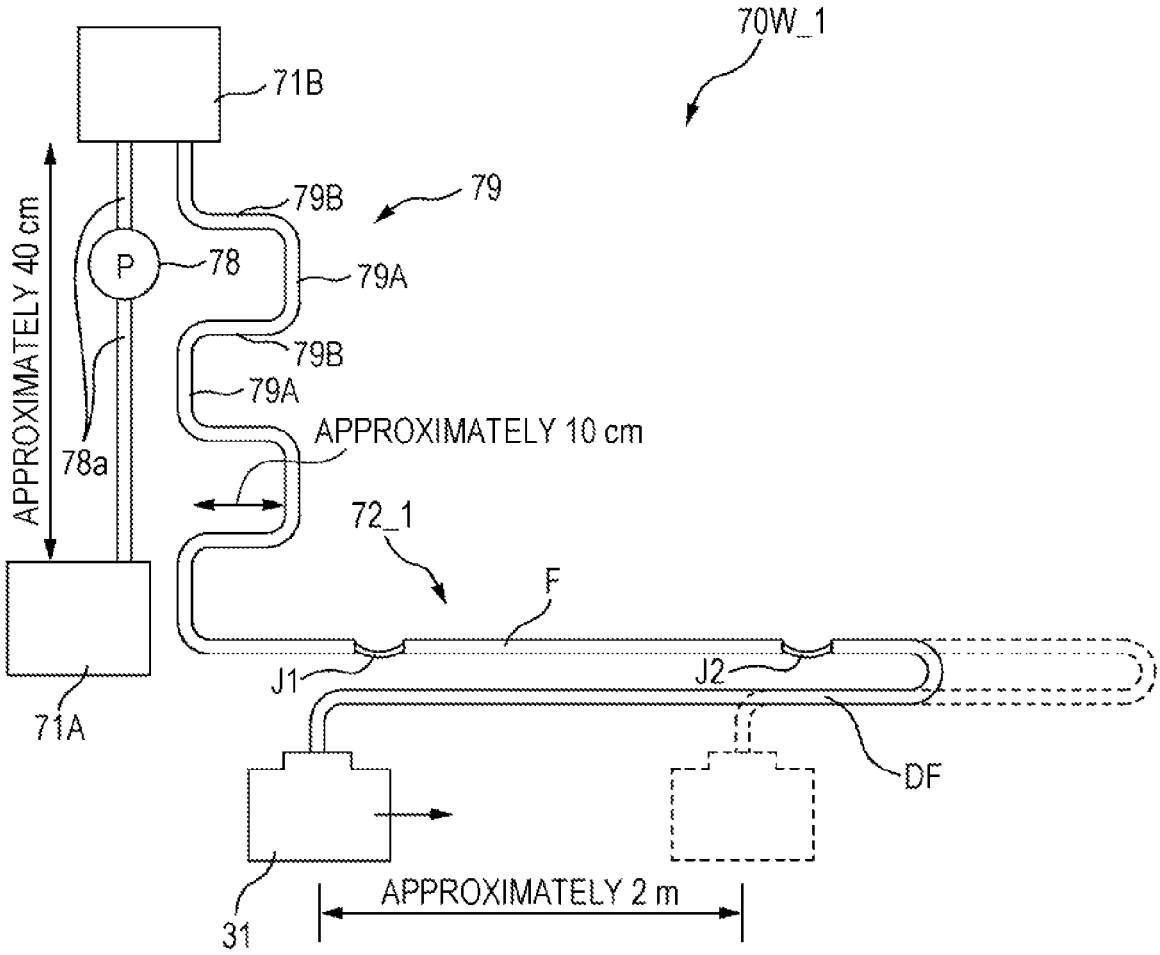
FIG. 11 is an explanatory diagram illustrating a white ink supply section included in the ink supply unit according to the second embodiment.

FIG. 11 is an explanatory diagram illustrating the white ink supply section 70W_1 included in the ink supply unit according to the second embodiment.

Hereinafter, the white ink supply section 70W_1 will be described in detail with reference to FIG. 11. Meanwhile, the color ink supply section which is another component of the ink supply unit according to the second embodiment replaces a zigzag descending path 79 of the white ink supply section 70W_1, which will be described later, with a simply straight line flow path, and replaces a supply path 72_1 of the white ink supply section 70W_1, which will be described later, with a supply path 72' according to the first reference example which is described with reference to FIG. 5A (however, the second embodiment is different from the first embodiment in that the length thereof is long compared to the first reference example and is a quantitative length), and the description thereof will not be repeated.

The white ink supply section 70W_1 includes a main tank 71A, a sub tank 71B, the descending path 79, the supply path 72_1 (further, refer to FIG. 8 with regard to the supply path 72_1), an ascending path 78*a*, and a lifting pump 78. The main tank 71A is a large storage section which stores a large amount of ink. In contrast, the sub tank 71B is a small-sized storage section which temporarily stores the ink. The ascending path 78*a* is a flow path which connects the main tank 71A to the sub tank 71B, and includes a pipe-shaped tube. The lifting pump 78 is provided on the ascending path 78*a*. The sub tank 71B is provided in a higher place than the main tank 71A or the supply path 72_1, and the white ink of the main tank 71A is drawn to the sub tank 71B through the ascending path by the lifting pump 78. Here, the difference in height between the main tank 71A and the sub tank 71B is approximately 40 cm.

The descending path 79 is a flow path which is provided between the sub tank 71B and the supply path 72_1 and which has a large difference in height (water head difference), and is a flow path which is configured from a pipe-shaped tube such that the white ink of the sub tank 71B descends to the supply path 72_1 as much as the difference in height. Due to the difference in height (water head difference) in the descending path 79, the white ink in the sub tank 71B flows up to the carriage 31 (accurately, the head 41 which is mounted on the carriage 31) through the supply path 72_1. The descending path 79 is a zigzag flow path in which a vertical flow path 79A and a horizontal flow path 79B are alternately arranged. Here, the vertical flow path 79A is a flow path through which the white ink flows in the vertical direction, and is a flow path in which the difference in height is present. Meanwhile, the flow path in which the difference in height is present may be formed by inclining the flow path instead of forming a flow path in the vertical direction. In contrast, the horizontal flow path 79B is a flow path through which the white ink flows in the horizontal direction, and a flow path in which the difference in height is not present.

If the descending path 79 is configured from a single straight vertical flow path (or an inclined flow path) instead of the zigzag flow path, the pigment of the white ink in the flow path settles down in the same place, and thus the difference in concentration between a place where the concentration of the white ink is large and a place where the concentration is small is extremely large. In such a state it takes time in order to cancel the difference in the concentration of the white ink in the flow path and to perform homogenization. Further, a situation may occur in which the fluidity of the white ink is deteriorated in the place where the concentration of the white ink is large.

As described above, in the white ink supply section 70W_1, the zigzag flow path in which the vertical flow path 79A and the horizontal flow path 79B are alternately arranged is used as the descending path 79, and thus places in which the pigment of the white ink settles down and the concentration of the white ink is high are dispersed into a plurality of places in the flow path. Therefore, it is difficult for an extremely large difference in concentration to be present in the white ink supply section 70W_1.

Further, as shown in FIG. 11, in the white ink supply section 70W_1, two types, that is, the horizontal flow path 79B through which the ink flows toward the right side in the drawing and the horizontal flow path 79B through which the ink flows toward the left side in the drawing alternately appear in the descending path 79, and thus the white ink flows in a zigzag pattern in the right and left directions. The reason for this is to save a space for arrangement of the descending path 79 in the horizontal direction by reducing the entire width of the descending path 79 in the horizontal direction.

The supply path 72_1 is a flow path to supply the white ink which descends the descending path 79 to the carriage 31 (accurately, the head 41 which is mounted on the carriage 31). The supply path 72_1 is a flow path, the large part of which extends in the horizontal direction and which has the small difference in height, compared to the descending path 79. As shown in FIG. 11, the supply path 72_1 horizontally extends from the side of the tank 71A toward the right direction in the drawing, is folded back, horizontally extends toward the left direction in the drawing, and then is connected to the carriage 31 (accurately, connected to the head 41 which is mounted on the carriage 31). In other words, the supply path 72_1 is piped such that a path from the tank 71A to the carriage 31 becomes a U-shape. Here, as described above, it is possible for the carriage 31 to 2-dimensionally move in the XY plane. However, in FIG. 11, a case in which the carriage 31 moves in the XY plane by the above-described maximum movement distance (approximately, 2 m) is shown as an example, and a distance from a position shown by a solid line to a position shown by a dotted line in FIG. 11 is the maximum movement distance (approximately 2 m).

The supply path 72_1 is configured to include a horizontal part F which extends in the horizontal direction in the upper side part of the U-shaped form, two connection parts J1 and J2 on both sides of the horizontal part F, and a downstream part DF of the downstream side in the ink supply direction compared to the connection part J2. Meanwhile, the connection part J1 is connected to the lowermost horizontal flow path 79B in the above-described descending path 79. The horizontal part F, the two connection parts J1 and J2, and the downstream part DF are substantially the same as the horizontal part F, the two connection parts J1 and J2, and the downstream part DF in the supply path 72 shown in FIGS. 5C, 7A and 7B except for the difference in length. Similar to the first embodiment, the second embodiment is also provided with an acceleration mechanism which accelerates the horizontal part F in the downward vertical direction (downward in the drawing). The acceleration mechanism is the same as described with reference to FIGS. 7A and 7B. Here, the duplicated description thereof will not be repeated.

Meanwhile, since there is a case in which the pigment of the ink settles down in the descending path 79 in the second embodiment, the descending path 79 may include a mechanism which circulates the white ink using the pump as in the second reference example.

Other Embodiment

In the embodiments, the sedimentary ink is described as a white ink. However, the kind of the sedimentary ink is not limited thereto.

For example, there is glitter ink (metallic ink) as ink that includes components which settle down. The glitter ink contains a silver particle or aluminum (flaky aluminum or squamous aluminum) as a metal particle. The silver particle is a particle which contains silver as a principal component. The silver particle may contain another metal, oxygen, or carbon as, for example, an accessory component. The silver particle may be an alloy of silver and another metal. It is possible for the glitter ink to form a glitter image with high glossiness. Pure water or ultrapure water, such as deionized water, ultrafiltration water, Milli-Q water, or distilled water, is used as a solvent of the glitter ink. In addition, if necessary, surfactants, moisturizing agents, thickeners, pH regulators, preservatives, resins, and the like may be included.

In addition, in the embodiments, it is assumed that pigments settle down. However, components which settle down may be components other than pigments.

In addition, in the embodiment, the ink jet-type printer is described as a liquid ejecting apparatus. However, the invention is not limited thereto and it is possible to realize a liquid ejecting apparatus which ejects or discharges a fluid other than ink (liquid, liquid in which functional material particles are dispersed, and fluids such as gel). For example, a technology which is the same as the above-described embodiments may be applied to various apparatuses to which an ink jet technology is applied, such as a color filter manufacturing apparatus, a dyeing apparatus, a fine processing apparatus, a semiconductor manufacturing apparatus, a surface processing apparatus, a 3-dimensional molding machine, a gas vaporization apparatus, an organic EL manufacturing apparatus (more specifically, a polymer EL manufacturing apparatus), a display manufacturing apparatus, a film formation apparatus, a DNA chip manufacturing apparatus, and the like. In addition, the methods and manufacturing methods are included in a category of an application range.

The embodiments are provided to easily understand the invention, and are not provided for limited interpretation of the invention. The invention may be changed and amended without departing from the gist thereof. Further, it is apparent that the invention includes the equivalents thereof.

The entire disclosure of Japanese Patent Application No. 2013-062207, filed Mar. 25, 2013 is expressly incorporated by reference herein.

What is claimed is:

1. A liquid ejecting apparatus comprising:

a head that discharges liquid having a component which settles down;

a storage section that stores the liquid;

a supply path that supplies the liquid from the storage section to the head through a path which extends in a horizontal direction; and an acceleration section that accelerates a part of the supply path which includes at least the path with acceleration having a downward acceleration component in the vertical direction, wherein the part of the supply path that is accelerated includes one or more flexible members that allow the supply path to be moved by the acceleration section to cause the downward acceleration component, wherein the supply path includes:

a pipe-shaped upstream part which has one end connected to the storage section;

a first pipe-shaped connection part which has one end connected to another end of the upstream part and which has flexibility, the first pipe-shaped connection part comprising one of the one or more flexible members;

a pipe-shaped horizontal part which has one end connected to another end of the first pipe-shaped connection part and which extends in the horizontal direction;

a second pipe-shaped connection part which has one end connected to another end of the horizontal part and which has flexibility the second pipe-shaped connection part comprising one of the one or more flexible members; and a pipe-shaped downstream part which has one end connected to another end of the second pipe-shaped connection part and another end connected to the head, wherein the acceleration section accelerates the pipe-shaped horizontal part relatively to the pipe-shaped upstream part and the pipe-shaped downstream part with the acceleration, and wherein the first pipe-shaped connection part and the second pipe-shaped connection part include clearance for securing at least movement distance in which the pipe-shaped horizontal part moves relatively to the pipe-shaped upstream part and the pipe-shaped downstream part until the acceleration of the pipe-shaped horizontal part is completed by the acceleration section, and are respectively connected between the pipe-shaped upstream part and the pipe-shaped horizontal part and between the pipe-shaped horizontal part and the pipe-shaped downstream part before movement of the pipe-shaped horizontal part starts.

2. The liquid ejecting apparatus according to claim 1, wherein each of the first pipe-shaped connection part and the second pipe-shaped connection part is configured from a material which is relatively flexible compared to the pipe-shaped horizontal part, the pipe-shaped upstream part, and the pipe-shaped downstream part.

3. The liquid ejecting apparatus according to claim 1, wherein the acceleration section includes:

a support member that supports the horizontal part and that is capable of moving in a vertical direction together with the supported horizontal part;

a support member moving section that moves the support member upward in the vertical direction; and an abutting member that is provided above the support member in the vertical direction, and applies acceleration in the downward vertical direction, which changes a movement velocity of the support member upward in the vertical direction to zero by abutting on the support member which moves upward in the vertical direction and suddenly stopping movement of the support member, to the support member.

4. The liquid ejecting apparatus according to claim 3, further comprising:

a control section that controls the support member moving section such that the support member moves, and controls the support member moving section after the movement of the support member stops such that the support member returns to a position before the movement.

5. The liquid ejecting apparatus according to claim 4, wherein the liquid ejecting apparatus receives a designation of an extent of a time interval, at which the support member abuts on the abutting member, from a user, and wherein the control section performs control such that the support member moves and performs control after the movement stops such that the support member returns to a position before the movement at every designated time interval.

6. The liquid ejecting apparatus according to claim 5, wherein, as duration of a state in which the liquid is not discharged from the head is long, the control section performs control such that the support member moves and performs control after the movement stops such that the support member returns to the position before the movement at a short time interval.

7. The liquid ejecting apparatus according to claim 1, wherein the acceleration section accelerates the part of the supply path with the acceleration regardless of whether or not the liquid is discharged from the head.

* * * * *